US006318388B1

(12) United States Patent
Edmiston et al.

(10) Patent No.: US 6,318,388 B1
(45) Date of Patent: Nov. 20, 2001

(54) ENGINE FLUSHING APPARATUS

(76) Inventors: Donald C. Edmiston; Kristin K. Edmiston, both of 120 Sleepy Hollow Cir., Denver, PA (US) 17517

( * ) Notice: Subject to any disclaimer, the term of this patent is extended or adjusted under 35 U.S.C. 154(b) by 0 days.

(21) Appl. No.: 09/480,518

(22) Filed: Jan. 7, 2000

(51) Int. Cl.[7] ..... B08B 9/08
(52) U.S. Cl. ..... 134/169 A
(58) Field of Search ..... 134/169 A; 184/1.5

(56) References Cited

U.S. PATENT DOCUMENTS 5,048,578 * 9/1991 Dorf et al. ..... 184/1.5 X
5,168,844 * 12/1992 Waelput ..... 184/1.5 X
5,232,513 * 8/1993 Suratt et al. ..... 134/169 A X
5,474,098 * 12/1995 Grigorian et al. ..... 134/169 A
5,566,781 * 10/1996 Robert et al. ..... 134/169 A X
5,765,612 * 6/1998 Morin ..... 184/1.5 X
5,816,272 * 10/1998 Leaphart ..... 134/169 A X
5,975,156 * 11/1999 Senour ..... 184/1.5 X
6,247,509 * 6/2001 Rome et al. ..... 184/1.5 X

* cited by examiner

*Primary Examiner*—Philip R. Coe

(57) ABSTRACT

A engine flushing apparatus for providing a convenient and easily portable complete apparatus for flushing the oil-lubricated portions of an engine. The engine flushing apparatus includes a solution tank for holding a solution. The solution tank comprises an upper opening and a substantially hollow interior. A suction conduit extends into the interior of the solution tank from the opening. A waste solution tank holds waste solution. The waste solution tank comprises an upper opening and a substantially hollow interior. A drain conduit extends into the interior of the waste solution tank from the opening. A pump circulates solution. The pump is in fluid communication with the suction conduit of the solution tank. An inlet conduit carries solution to the engine. The inlet conduit is adapted for connection to the oil fill opening of the engine. An outlet conduit carries solution away from the engine. The outlet conduit is connected to the oil drain opening of the engine. A transport cart carries the pump, solution and waste solution tanks.

14 Claims, 2 Drawing Sheets

ENGINE FLUSHING APPARATUS

BACKGROUND OF THE INVENTION

1. Field of the Invention

The present invention relates to engine flushing systems and more particularly pertains to a new engine flushing apparatus for providing a convenient and easily portable complete apparatus for flushing the oil-lubricated portions of an engine.

2. Description of the Prior Art

The use of engine flushing systems is known in the prior art. More specifically, engine flushing systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,232,513; 5,154,775; 5,427,202; 5,383,481; 5,318,080; and 5,238,085.

While these devices fulfill their respective, particular objectives and requirements, the aforementioned patents do not disclose a new engine flushing apparatus. The inventive device includes a solution tank for holding a solution. The solution tank comprises an upper opening and a substantially hollow interior. A suction conduit extends into the interior of the solution tank from the opening. A waste solution tank holds waste solution. The waste solution tank comprises an upper opening and a substantially hollow interior. A drain conduit extends into the interior of the waste solution tank from the opening. A pump circulates solution. The pump is in fluid communication with the suction conduit of the solution tank. An inlet conduit carries solution to the engine. The inlet conduit is adapted for connection to the oil fill opening of the engine. An outlet conduit carries solution away from the engine. The outlet conduit is adapted for connection to the oil drain opening of the engine. A transport cart carries the pump, solution and waste solution tanks.

In these respects, the engine flushing apparatus according to the present invention substantially departs from the conventional concepts and designs of the prior art, and in so doing provides an apparatus primarily developed for the purpose of providing a convenient and easily portable complete apparatus for flushing the oil-lubricated portions of an engine.

SUMMARY OF THE INVENTION

In view of the foregoing disadvantages inherent in the known types of engine flushing systems now present in the prior art, the present invention provides a new engine flushing apparatus construction wherein the same can be utilized for providing a convenient and easily portable complete apparatus for flushing the oil-lubricated portions of an engine.

The general purpose of the present invention, which will be described subsequently in greater detail, is to provide a new engine flushing apparatus apparatus and method which has many of the advantages of the engine flushing systems mentioned heretofore and many novel features that result in a new engine flushing apparatus which is not anticipated, rendered obvious, suggested, or even implied by any of the prior art engine flushing systems, either alone or in any combination thereof.

To attain this, the present invention generally comprises a solution tank for holding a solution. The solution tank comprises an upper opening and a substantially hollow interior. A suction conduit extends into the interior of the solution tank from the opening. A waste solution tank holds waste solution. The waste solution tank comprises an upper opening and a substantially hollow interior. A drain conduit extends into the interior of the waste solution tank from the opening. A pump circulates solution. The pump is in fluid communication with the suction conduit of the solution tank. An inlet conduit carries solution to the engine. The inlet conduit is adapted for connection to the oil fill opening of the engine. An outlet conduit carries solution away from the engine. The outlet conduit is adapted for connection to the oil drain opening of the engine. A transport cart carries the pump, solution and waste solution tanks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new engine flushing apparatus apparatus and method which has many of the advantages of the engine flushing systems mentioned heretofore and many novel features that result in a new engine flushing apparatus which is not anticipated, rendered obvious, suggested, or even implied by any of the prior art engine flushing systems, either alone or in any combination thereof.

It is another object of the present invention to provide a new engine flushing apparatus which may be easily and efficiently manufactured and marketed.

It is a further object of the present invention to provide a new engine flushing apparatus which is of a durable and reliable construction.

An even further object of the present invention is to provide a new engine flushing apparatus which is susceptible of a low cost of manufacture with regard to both materials and labor, and which accordingly is then susceptible of low prices of sale to the consuming public, thereby making such engine flushing apparatus economically available to the buying public.

Still yet another object of the present invention is to provide a new engine flushing apparatus which provides in the apparatuses and methods of the prior art some of the advantages thereof, while simultaneously overcoming some of the disadvantages normally associated therewith.

Still another object of the present invention is to provide a new engine flushing apparatus for providing a convenient and easily portable complete apparatus for flushing the oil-lubricated portions of an engine.

Yet another object of the present invention is to provide a new engine flushing apparatus which includes a solution tank for holding a solution. The solution tank comprises an upper opening and a substantially hollow interior. A suction conduit extends into the interior of the solution tank from the opening. A waste solution tank holds waste solution. The waste solution tank comprises an upper opening and a substantially hollow interior. A drain conduit extends into the interior of the waste solution tank from the opening. A pump circulates solution. The pump is in fluid communication with the suction conduit of the solution tank. An inlet conduit carries solution to the engine. The inlet conduit is adapted for connection to the oil fill opening of the engine. An outlet conduit carries solution away from the engine. The outlet conduit is adapted for connection to the oil drain opening of the engine. A transport cart carries the pump, solution and waste solution tanks.

Still yet another object of the present invention is to provide a new engine flushing apparatus that provides containment of the flushing solution both prior to and after flushing of the engine.

Even still another object of the present invention is to provide a new engine flushing apparatus that easily connects to suitable openings on an engine for circulating flushing solution through the oil passages of an engine through pressure and suction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
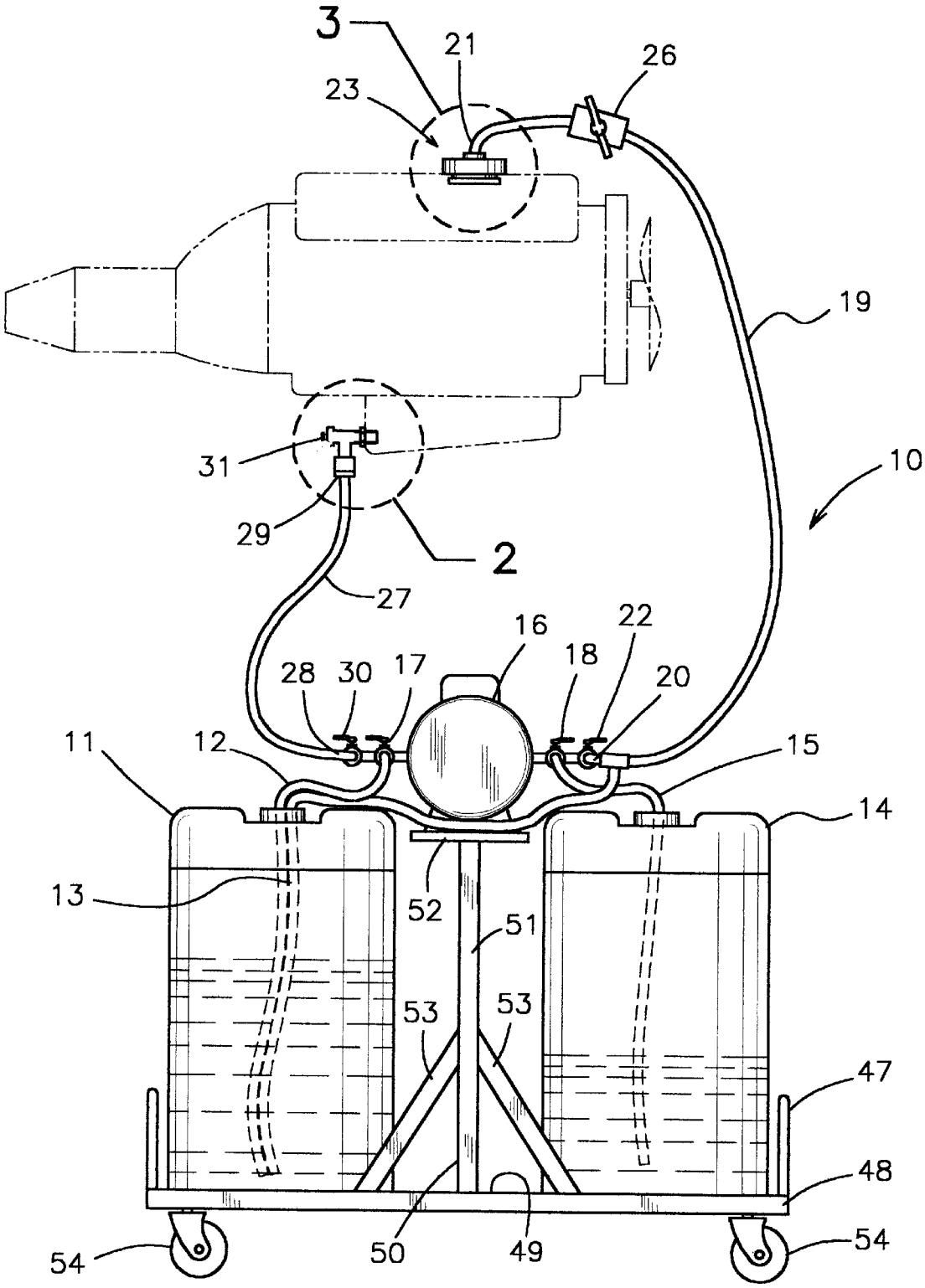
FIG. 1 is an elevational view of a new engine flushing apparatus according to the present invention.

With reference now to the drawings, and in particular to FIGS. 1 through 4 thereof, a new engine flushing apparatus embodying the principles and concepts of the present invention and generally designated by the reference numeral 10 will be described.

As best illustrated in FIGS. 1 through 4, the engine flushing apparatus 10 generally comprises a solution tank 11 for holding a solution. The solution tank comprises an upper opening, a substantially hollow interior and a bottom. A suction conduit 12 extends into the interior of the solution tank from the opening toward the bottom thereof. A bypass conduit 13 extends through the opening toward the bottom of the solution tank. The solution comprises a solvent such as kerosene.

As shown in FIG. 1, a waste solution tank 14 holds waste solution. The waste solution tank comprises an upper opening, a substantially hollow interior and a bottom. A drain conduit 15 extends into the interior of the waste solution tank from the opening toward the bottom thereof. The waste solution comprises a solution that has been circulated through the engine.

A pump 16 circulates the solution. The pump is in fluid communication with the suction conduit of the solution tank. A valve 17 is fluidly interposed between the pump and the suction conduit. The pump is in fluid communication with the drain conduit of the waste solution tank. A valve 18 is fluidly interposed between the pump and the drain conduit.

Figure 3:
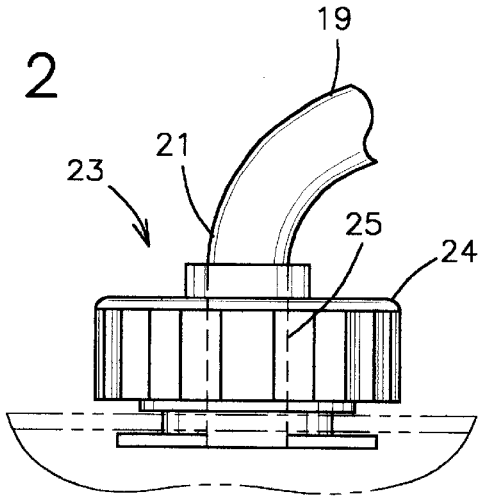
FIG. 3 is an enlarged view of the area designated with the number 3 in FIG. 1 of the present invention.

An inlet conduit 19 carries solution to the engine. The inlet conduit is adapted for connection to the oil fill opening of the engine. The inlet conduit comprises a first end 20 and a second end 21. The first end is connected to the pump and the second end is connectable to the oil fill opening of the engine. A valve 22 is fluidly interposed between the pump and the inlet conduit. As shown in FIG. 3, an inlet adapter 23 is connected to the oil fill opening of the engine. The inlet adapter is mounted on the second end of the inlet conduit. The inlet adapter comprises a cap 24 with an aperture 25 therethrough. The cap comprises a structure similar to a closure cap for closing the oil fill opening of the engine. A valve 26 is in fluid communication with the inlet conduit for selectively blocking flow of solution through the inlet conduit. The valve is located near the second end of the inlet conduit.

Figure 2:
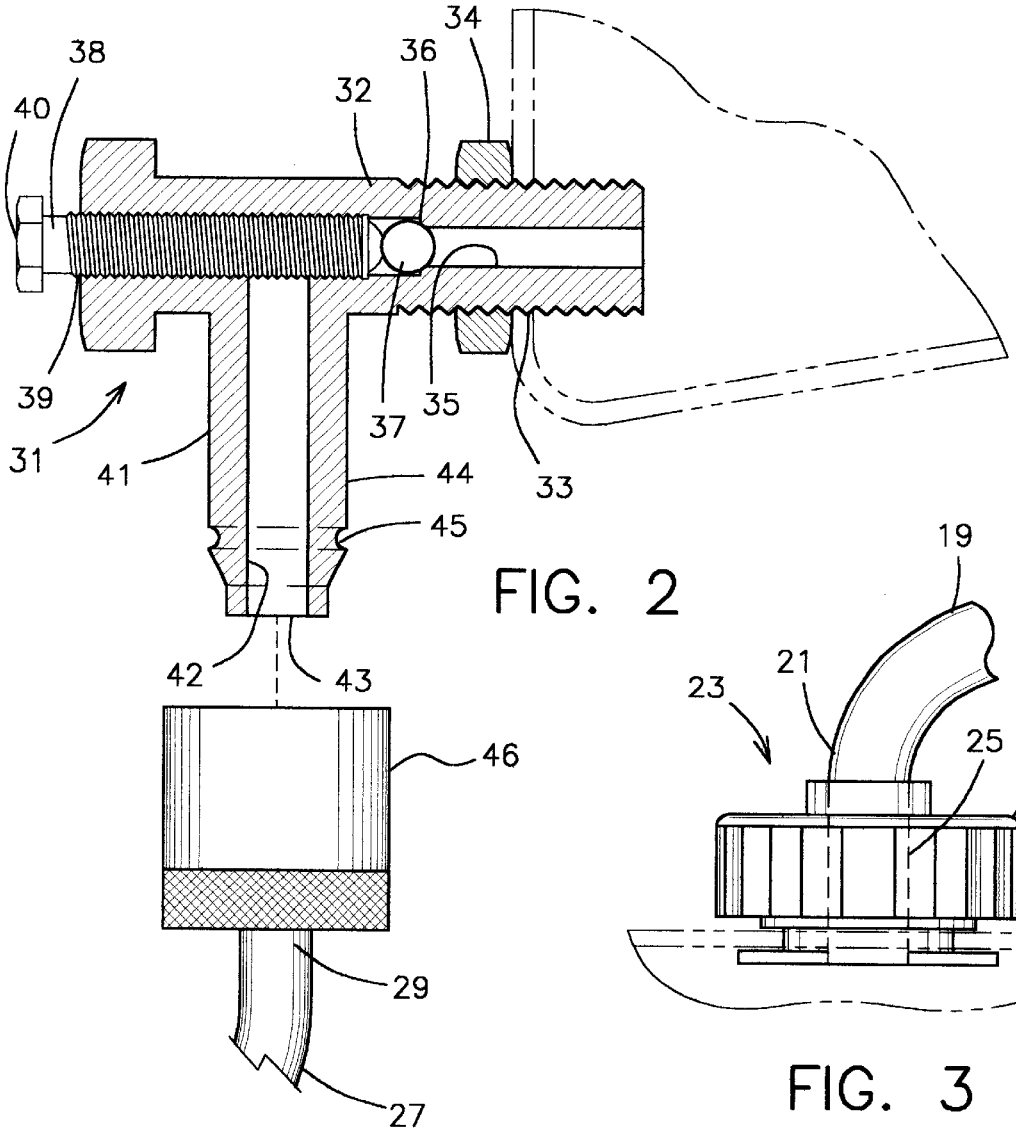
FIG. 2 is an enlarged cross-sectional view of the area designated with the number 2 in FIG. 1 of the present invention.

An outlet conduit 27 carries solution away from the engine. The outlet conduit is adapted for connection to the oil drain opening of the engine. The outlet conduit comprises a first end 28 and a second end 29. The first end is connected to the pump and the second end is connectable to the oil drain opening of the engine. A valve 30 is fluidly interposed between the pump and the outlet conduit. As shown in FIG. 2, an outlet adapter 31 connects to the oil drain opening of the engine. The outlet adapter is mounted to the second end of the outlet conduit. The outlet adapter comprising a nipple portion 32 for inserting into the oil drain opening of the engine. The nipple portion comprises a threaded exterior surface 33 for threading into the oil drain opening. A nut 34 is threaded on the nipple portion for locking the outlet adapter in the oil drain opening. The nipple portion comprises a first passage 35 therethrough. The first passage comprises a shoulder 36 formed therein. A ball 37 is positioned adjacent to the shoulder and comprises a diameter permitting the ball to close the first passage when the ball is abutted against the shoulder. A threaded member 38 is positioned in the first passage for selectively abutting the ball against the shoulder. The threaded member comprises a threaded exterior surface 39 for engaging threads on the interior surface of the first passage such that the threaded member may be advanced and retracted by rotation of the threaded member. The threaded member comprises a hex head 40 thereon for permitting a wrench to engage the threaded member. A connector portion 41 is mounted to the nipple portion and comprises a second passage 42 in fluid communication with the first passage. The connector portion comprises an opening 43 in communication with the second passage. An exterior surface 44 of the connector portion comprises an annular groove 45. A coupler 46 on the second end of the outlet conduit is removably couplable to the connector portion of the outlet adapter.

As shown in FIG. 1, a transport cart 47 comprises a base 48 with an upper surface 49 for resting the solution and waste solution tanks. A pump support 50 is mounted on the transport cart. The pump support extends upward from the base. The pump support comprises an upstanding member 51 mounted on the base, a support 52 mounted on an upper end of the upstanding member. The support further comprises an upper surface for resting the pump thereon and a plurality of brace members 53 extending from the upstanding member and the base. A plurality of wheels 54 are mounted on the base. The solution tank and the waste solution tank rest on the upper surface of the base and are adapted for permitting lifting removal from the base for filling or emptying the tanks.

Figure 4:
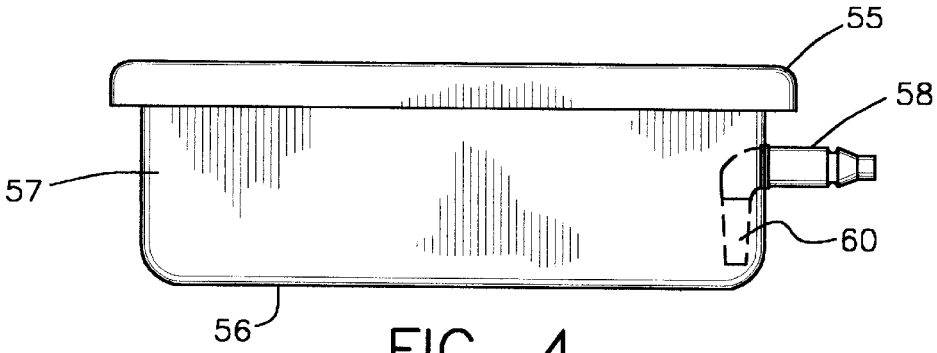
FIG. 4 is an elevational view of the washer tray of the present invention.

As shown in FIG. 4, a washer tray 55 comprises a bottom wall 56 and a perimeter wall 57 extending substantially perpendicularly to a perimeter of the bottom wall. The washer tray comprises a solution return fitting 58 extending through the perimeter wall and comprises a portion 60 extending adjacent to the bottom wall for suctioning solution from the bottom of the washer tray.

In an embodiment the washer tray can be used in place of the engine to produce a stand alone parts cleaner. In another embodiment the engine flushing apparatus can be used flush other lubricant containing devices such as vehicle transmissions and differentials.

In use, the user connects the inlet adapter to the oil fill port of the engine such that the inlet conduit connects oil fill port and the solution tank. The outlet adapter is then connected to the oil drain opening such that the outlet conduit connects the oil drain opening with the waste solution tank. The pump is then turned on and the solution is pumped from the solution tank into the engine through the oil fill port. The solution works through the engine and collects in the oil pan of the engine where the pump extracts the used solution through the outlet adapter into the waste solution tank thereby cleaning debris and used lubricant from the engine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An engine flushing system for flushing an engine having an oil circulation system including an oil fill opening at an upper location on the engine and an oil drain opening on a lower location on the engine, the engine flushing system comprising:

a solution tank for holding a solution, the solution tank having an upper opening and a substantially hollow interior, a suction conduit extending into the interior of the solution tank from the opening;

a waste solution tank for holding waste solution, the waste solution tank having an upper opening and a substantially hollow interior, a drain conduit extending into the interior of the waste solution tank from the opening;

a pump for circulating solution, the pump being in fluid communication with the suction conduit of the solution tank;

an inlet conduit for carrying solution to the engine, the inlet conduit being adapted for connection to the oil fill opening of the engine;

an outlet conduit for carrying solution away from the engine, the outlet conduit being adapted for connection to the oil drain opening of the engine; and a transport cart.

2. The engine flushing system as set forth in claim 1 further comprising a bypass conduit extending through the opening toward a bottom of the solution tank.

3. The engine flushing system as set forth in claim 1 wherein the solution comprises a solvent.

4. The engine flushing system as set forth in claim 3 wherein the solution comprises kerosene.

5. The engine flushing system as set forth in claim 1 further comprising a valve being fluidly interposed between the pump and the suction conduit, the pump being in fluid communication with the drain conduit of the waste solution tank.

6. The engine flushing system as set forth in claim 5 wherein the inlet conduit has a first end and a second end, the first end being connected to the pump and the second end being connectable to the oil fill opening of the engine.

7. The engine flushing system as set forth in claim 6 further comprising an inlet adapter for connecting to the oil fill opening of the engine, the inlet adapter being mounted on the second end of the inlet conduit, the inlet adapter having a cap with a aperture therethrough, the cap having a structure similar to a closure cap for closing the oil fill opening of the engine.

8. The engine flushing system as set forth in claim 1 wherein the outlet conduit has a first end and a second end, the first end being connected to the pump and the second end being connectable to the oil drain opening of the engine.

9. The engine flushing system as set forth in claim 8 further comprising an outlet adapter for connecting to the oil drain opening of the engine, the outlet adapter being mounted to the second end of the outlet conduit, the outlet adapter comprising a nipple portion for inserting into the oil drain opening of the engine, the portion nipple having a threaded exterior surface for threading into the oil drain opening, a nut being threaded on the nipple portion for locking the outlet adapter in the oil drain opening.

10. The engine flushing system as set forth in claim 9 wherein the nipple portion has a first passage therethrough, the first passage having a shoulder formed therein, a ball being positioned adjacent to the shoulder and having a diameter permitting the ball to close the first passage when the ball is abutted against the shoulder, a threaded member positioned in the first passage for selectively abutting the ball against the shoulder.

11. The engine flushing system as set forth in claim 10 further comprising a connector portion mounted to the nipple portion and having a second passage in fluid communication with the first passage, the connector portion having an opening in communication with the second passage, an exterior surface of the connector portion having an annular groove, a coupler on the second end of the outlet conduit being removably couplable to the connector portion of the outlet adapter.

12. The engine flushing system as set forth in claim 1 wherein the transport cart has a base with an upper surface for resting the solution and drain tanks, a pump support being mounted on the transport cart, the pump support extending upward from the base.

13. The engine flushing system as set forth in claim 1 further comprising a washer tray having a bottom wall and a perimeter wall extending substantially perpendicularly to a perimeter of the bottom wall, the washer tray having a solution return fitting extending through the perimeter wall and having a portion extending adjacent to the bottom wall for suctioning solution from the bottom of the washer tray.

14. An engine flushing system for flushing an engine having an oil circulation system including an oil fill opening at an upper location on the engine and an oil drain opening on a lower location on the engine, the engine flushing system comprising:

a solution tank for holding a solution, the solution tank having an upper opening and a substantially hollow interior, the solution tank having a bottom, a suction conduit extending into the interior of the solution tank from the opening toward the bottom thereof, a bypass conduit extending through the opening toward the bottom of the solution tank, wherein the solution comprises a solvent, wherein the solution comprises kerosene;

a waste solution tank for holding waste solution, the waste solution tank having an upper opening and a substantially hollow interior, the waste solution tank having a bottom, a drain conduit extending into the interior of the waste solution tank from the opening toward the bottom thereof, wherein the waste solution comprises a solution that has been circulated through the engine;

a pump for circulating solution, the pump being in fluid communication with the suction conduit of the solution tank, a valve being fluidly interposed between the pump and the suction conduit, the pump being in fluid communication with the drain conduit of the waste solution tank, a valve being fluidly interposed between the pump and the drain conduit;

an inlet conduit for carrying solution to the engine, the inlet conduit being adapted for connection to the oil fill opening of the engine, the inlet conduit having a first end and a second end, the first end being connected to the pump and the second end being connectable to the oil fill opening of the engine, a valve being fluidly interposed between the pump and the inlet conduit, an inlet adapter for connecting to the oil fill opening of the engine, the inlet adapter being mounted on the second end of the inlet conduit, the inlet adapter having a cap with a aperture therethrough, the cap having a structure similar to a closure cap for closing the oil fill opening of the engine, a valve in fluid communication with the inlet conduit for selectively blocking flow of solution through the inlet conduit, the valve being located near the second end of the inlet conduit;

an outlet conduit for carrying solution away from the engine, the outlet conduit being adapted for connection to the oil drain opening of the engine, the outlet conduit having a first end and a second end, the first end being connected to the pump and the second end being connectable to the oil drain opening of the engine, a valve being fluidly interposed between the pump and the outlet conduit, an outlet adapter for connecting to the oil drain opening of the engine, the outlet adapter being mounted to the second end of the outlet conduit, the outlet adapter comprising a nipple portion for inserting into the oil drain opening of the engine, the nipple portion having a threaded exterior surface for threading into the oil drain opening, a nut being threaded on the nipple portion for locking the outlet adapter in the oil drain opening, the nipple portion having a first passage therethrough, the first passage having a shoulder formed therein, a ball being positioned adjacent to the shoulder and having a diameter permitting the ball to close the first passage when the ball is abutted against the shoulder, a threaded member positioned in the first passage for selectively abutting the ball against the shoulder, the threaded member having a threaded exterior surface for engaging threads on the interior surface of the first passage such that the threaded member may be advanced and retracted by rotation of the threaded member, the threaded member having a hex head thereon for permitting a wrench to engage the threaded member, a connector portion mounted to the nipple portion and having a second passage in fluid communication with the first passage, the connector portion having an opening in communication with the second passage, an exterior surface of the connector portion having an annular groove, a coupler on the second end of the outlet conduit being removably couplable to the connector portion of the outlet adapter;

a transport cart, the transport cart having a base with an upper surface for resting the solution and drain tanks, a pump support being mounted on the transport cart, the pump support extending upward from the base, the pump support comprising:

an upstanding member mounted on the base, a support mounted on an upper end of the upstanding member, the support having an upper surface for resting the pump thereon, a plurality of brace members extending from the upstanding member and the base, a plurality of wheels mounted on the base;

wherein the solution tank and the waste solution tank are rested on the upper surface of the base and being adapted for permitting lifting removal from the base for filling or emptying the tanks;

a washer tray having a bottom wall and a perimeter wall extending substantially perpendicularly to a perimeter of the bottom wall, the washer tray having a solution return fitting extending through the perimeter wall and having a portion extending adjacent to the bottom wall for suctioning solution from the bottom of the washer tray.

* * * * *